United States Patent [19]

Derby et al.

[11] 3,975,789

[45] Aug. 24, 1976

[54] COMPLIANT TAPE CLEANER FOR MAGNETIC RECORDING TAPES

[75] Inventors: Howard L. Derby; August P. Epina, both of Boulder; Dennis R. Olmsted, Broomfield; Sanford Platter; Zoltan L. Herger, both of Boulder, all of Colo.

[73] Assignee: Storage Technology Corporation, Louisville, Colo.

[22] Filed: Apr. 3, 1975

[21] Appl. No.: 564,684

[52] U.S. Cl. ..... 15/306 A; 15/309

[51] Int. Cl.[2] ..... B08B 5/04

[58] Field of Search ..... 15/100, 303, 306 A, 15/308, 309

[56] References Cited

UNITED STATES PATENTS 1,623,528 4/1927 Moos ..... 15/306 A X 3,745,602 7/1973 Beistle ..... 15/308

*Primary Examiner*—Christopher K. Moore

*Attorney, Agent, or Firm*—Woodcock Washburn Kurtz & Mackiewicz

[57] ABSTRACT

Cleaning apparatus for removing foreign material from the front or oxide-covered surface of a magnetic recording tape. A sharp edged blade is mounted near a pad of open-cell reticulated foam material, and in close proximity to the front surface of a magnetic tape. A source of negative pressure is coupled to the region of the blade and cell and when actuated serves to draw the tape against the blade and foam material. Foreign material removed from the surface of the tape is embedded in the foam pad, and collected upon the blade. Air flow effected by the negative pressure area serves to transport some of the contaminants away from the region about the blade and foam pad.

11 Claims, 2 Drawing Figures

COMPLIANT TAPE CLEANER FOR MAGNETIC RECORDING TAPES

BACKGROUND OF THE INVENTION

The present invention relates to cleaning means for a transported magnetic tape and, more particularly, to improved means for removing foreign material from the oxide-covered surface of the magnetic tape.

In using magnetic tape for storing signals to be utilized by a digital machine, and particularly a computer, it is necessary to transport the tape rapidly but in close proximity to the read/write transducers, termed heads, which detect or induce flux reversals in the tape surface. In order to accomplish this it is necessary that the tape not be spaced too far from the surface of the head, in which case the lines of flux emanating from the tape surface will be too weak to be accurately detected by the heads.

Previous tape machines, i.e. those operating at a rate of 3200 flux reversals per inch (f.r.p.i.) have been able to withstand transient head-to-tape separations up to 200 microinches due to foreign substances from the tape surface build up upon the heads. To combat this problem various tape cleaning devices have been devised, primarily including mechanical scraping devices for physically separating foreign matter from the surface of the tape.

With the advent of modern, high-density digital machinery, which commonly utilize a tape separation distance of approximately 70 microinches, the problem of foreign material upon tape surfaces has become particularly critical. In particular, prior art tape cleaning apparatus are not satisfactory for use with the more sensitive, modern equipment. Small foreign particles on the tape surface, which heretofore would not have been large enough to cause errors, will cause substantial errors when present on tapes of the high density variety. In addition, prior art cleaning apparatus do not remove soft particles or viscous materials from the surface very effectively. Still further, the previously used cleaning devices tend to accumulate foreign matter thereon which is from time to time transferred to the tape surface in relatively large amounts. Or the collected material can cause the tape to stick to the head and/or cleaner causing either a "no tape motion" condition, or pull out of the oxide from the tape.

It is therefore an object of the present invention to provide an improved apparatus for removing foreign matter from the surface of a transported magnetic tape.

It is another object of the present invention to provide an improved tape cleaning means which removes smaller particles than cleaners heretofore known.

Still another object of the invention is to provide an improved tape cleaning apparatus which is particularly well adapted to remove viscous materials from the surface of the tape.

SUMMARY OF THE INVENTION

Briefly stated, in accordance with one aspect of the present invention the foregoing objects are achieved by providing a substantially rigid cleaner body supporting thereon a sharp-edged blade, and a resilient pad of reticulated foam. A portion of the interior of the cleaner body defines a cavity, and a source of negative pressure is coupled thereto such that an area of negative pressure appears between the foam pad and blade for drawing the nearby tape against the pad and blade.

The air flow through the body of the apparatus and through the foam pad serves to remove accumulated foreign matter.

BRIEF DESCRIPTION OF THE DRAWING

While the specification concludes with claims particularly pointing out and distinctly claiming the subject matter which is regarded as the invention, it is believed that the invention will be better understood from the following description of a preferred embodiment taken in conjunction with the accompanying drawing in which:

DESCRIPTION OF A PREFERRED EMBODIMENT

Figure 1:
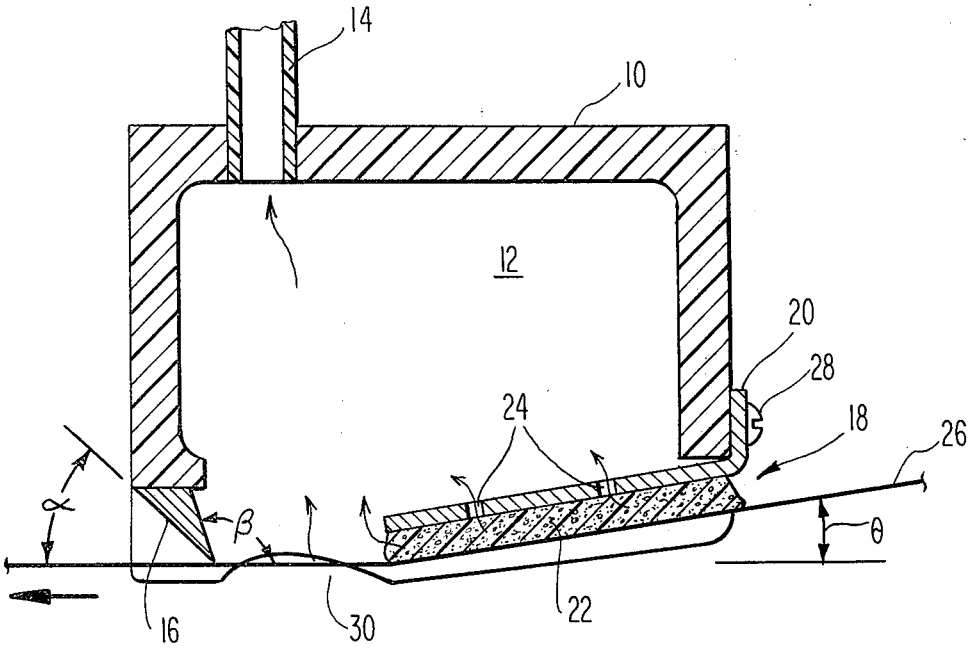
FIG. 1 is a sectional side elevation of one embodiment of the invention.

FIG. 1 shows, in cross-sectional form, one embodiment of the inventive tape cleaner. The cleaner comprises a body member 10 preferably made of a rigid, nonporous material such as metal or plastic. The interior of body 10 is hollow, defining a cavity 12 which communicates with a source of negative pressure (not shown) by means of a suitable conduit or tube 14. At the lower surface of one side of the body 10 is disposed a sharp scraper blade 14. The blade is preferably made of a hard, abrasion-resistant material of any suitable type. It is preferable that the blade not be made of a ferromagnetic material, since such a material may disturb the magnetic domains in the surface of the transported tape. Nonferromagnetic materials, such as carbides, high density aluminum oxide, stainless steels, etc. are readily available and familiar to those skilled in the art.

A portion of cavity 12 is covered by a compliant cleaner element generally designated 18. The cleaner comprises a rigid backing 20 and a foam element 22 attached to the lower surface of the backing. In one embodiment, a plurality of apertures 24 are formed in backing 20 for reasons to be explained hereinafter.

The foam element 22 is of an open-cell or reticulated foam material. In a successfully tested embodiment the foam element comprises a 1/16th inch thick pad of a polyurethane reticulated foam manufactured by the Foam Division of the Scott Paper Company of Chester, Pa. The foam advantageously is provided with 60 pores per inch (ppi), with a preferred range being from 50 to 70 ppi. As is evident from the Figure, the lower surface of the foam is advantageously oriented at an angle $\theta$ with a nominal undeflected direction of travel of a length of magnetic tape 26. Backing 20 is mounted to cleaner body 10 by means of screws 28, although obviously other fastening means may be used.

The downwardly-depending side walls of body 10, one of which is visible in the Figure, are cut away slightly in the region between the table 16 and inward end of foam pad 22, to form a relief as shown at 30. This provides a small channel through which outside air may pass above the path of the tape in order to allow a flow of air which carries off foreign matter accumulated at the rightward or forward side of blade 16.

Figure 2:
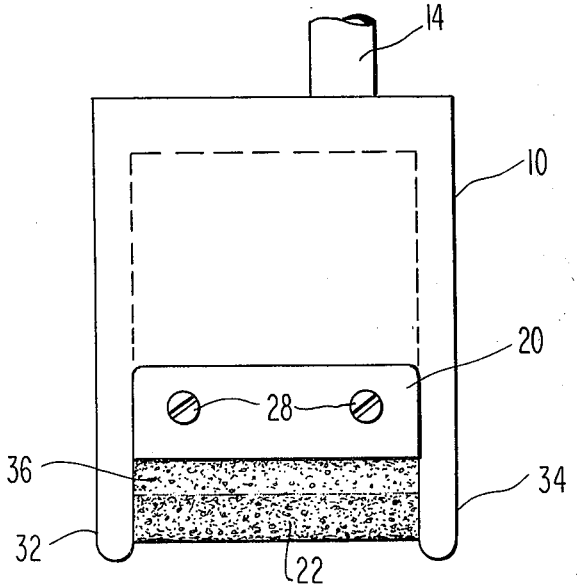
FIG. 2 is an end view of the embodiment of FIG. 1.

Turning now to FIG. 2 an end view of the cleaner is shown, the downwardly-depending side elements 32 and 34 being apparent. The lower surface of foam element 22 is seen, against which surface the front or coated side of a transported tape may be brought to bear. While the outward end 36 of the foam element is shown as open to the atmosphere, it will be understood that in some applications it may be desirable to provide means for blocking the end with a nonporous material so as to lessen the flow of air therethrough.

Returning to FIG. 1, as tape 26 is transported in the direction indicated by the arrow, foreign matter on the tape first encounters foam element 22, and subsequently the depending edge of blade 16. The combination of the tension upon tape 26 and the negative (i.e. below ambient) pressure occurring within cavity 12 of the cleaner causes the tape to be drawn firmly against the lower surface of foam element 22. This compresses the foam slightly, and forcibly entrains soft particles and viscous matter into the open-cell foam. Particles more firmly adhering to the surface of the tape are subsequently removed by blade 16.

As shown in the Figure, the limited air flow through porous form element 22 tends to draw the foreign material accumulated therein inwardly into the foam, and occasionally into cavity 12 from where it may be transported to a filter located downstream in conduit 14. Similarly, due to the air flow through relieved section 30 foreign matter removed from the tape surface by blade 16 may be carried from the interior of body 10 to a filtering element in conduit 14.

In one successfully tested embodiment the breakaway angle $\alpha$ of blade 16 with respect to tape 26 was at least 4°, the shear angle $\beta$ being no more than 120°. Angle $\theta$, which denotes the orientation of the lower surface of foam element 22, is advantageously between 0° and 1° and aids in maintaining the tape surface forcibly against the lower surfaces of the various cleaning elements.

In using the reticulated polyurethane foam described hereinabove it has been found advantageous to lubricate the surface of the foam with a low vapor pressure silicone oil. This lubricant may be sprayed upon the surface of the foam, then most of the residue wiped off to leave a thin layer on the foam. If too much lubricant is left, the residue will build up upon the oxide surface of the tape 26. The lubricant serves to lower the effective coefficient of friction of the foam pad surface, improving the tape driven performance in start and stop operations.

It is anticipated that after some period of usage the pores of foam element 22 will become clogged with foreign matter from the tape. At a convenient time, the associated pad and backing 20 may be removed from the cleaner body and rinsed with an appropriate solvent, such as alcohol, to remove the embedded foreign matter and renew the foam. Alternatively, and especially in view of the simplicity and low cost of the elements, it may be found advantageously to simply replace the pad of foam with a new one.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent at the United States is:

1. Means for removing foreign matter from the magnetizable surface of a length of tape as said tape traverses a path, comprising:

a body member;

blade means fixedly associated with said body member and having an edge to be disposed in the path of the tape for scraping foreign matter from the tape surface;

a resilient member of porous material;

means for mounting said resilient member to said body member and in the path of the tape;

said body member defining a cavity intermediate said blade means and said resilient member; and means for coupling the chamber of said body member to a source of negative pressure whereby the tape is urged against said resilient member, and foreign matter is transferred from the tape surface to said resilient member.

2. The invention defined in claim 1 wherein said cavity extends behind said resilient means.

3. The invention defined in claim 2 wherein said mounting means extends behind said resilient member and at least one aperture therein to place a surface of said resilient member in communication with said cavity for lowering the ambient pressure at the surface of said resilient member.

4. The invention defined in claim 3 wherein said body member comprises depending side elements which extend parallel to and at either side of a transported tape.

5. The invention defined in claim 4 wherein said resilient member comprises a pad of reticulated polyurethane foam.

6. Cleaning apparatus for removing foreign matter from the oxide surface of a length of moving magnetic tape, comprising:

body means disposed adjacent the path of the moving tape and defining a cavity therewithin;

blade means affixed to said body means and disposed in the path of the tape and having an edge for scraping said oxide surface;

a resilient porous element disposed in spaced relationship to said blade means and in the path of the tape;

means for coupling said cavity to a source of negative pressure, the negative pressure arising within said cavity assisting in urging the tape against said blade means and said porous element and creating a pressure drop across at least a portion of said porous element.

7. The invention defined in claim 6, further including a support means for supporting said porous element and removably attached to said body means.

8. The invention defined in claim 7 wherein said support means has at least one aperture extending therethrough.

9. The invention defined in claim 8 wherein the surface of said porous element which receives said magnetic tape is inclined with respect to a locus defining the path of the tape in the absence of said cleaning apparatus.

10. The invention defined in claim 9, wherein said body means further comprises two elongate side members extending substantially perpendicular to said blade means and alongside the path of the tape.

11. The invention defined in claim 10 wherein at least one of said side members is provided with a relief generally aligned intermediate said blade and said porous element for allowing a flow of air into said cavity.

* * * * *

UNITED STATES PATENT OFFICE

CERTIFICATE OF CORRECTION

Patent No. 3,975,789 Dated August 24, 1976

Inventor(s) Howard L. Derby et al

It is certified that error appears in the above-identified patent and that said Letters Patent are hereby corrected as shown below:

Col. 2, line 27, "blade 14" should be --blade 16--;

line 56, "table 16" should be --blade 16--.

Col. 4, claim 2, line 2, "means" should be --member--;

claim 6, line 1, "matter" should be --material--.

Signed and Sealed this

Seventh Day of December 1976

[SEAL]

*Attest:*

RUTH C. MASON
*Attesting Officer*

C. MARSHALL DANN
*Commissioner of Patents and Trademarks*